US005799789A

United States Patent [19]

Ritchie et al.

[11] Patent Number: 5,799,789

[45] Date of Patent: Sep. 1, 1998

[54] PORTABLE CONTAINER FOR SOCKETS

[75] Inventors: Fred Philip Ritchie; David Allen Trower, both of Waterloo, Iowa

[73] Assignee: Waterloo Industries, Inc., Waterloo, Iowa

[21] Appl. No.: 884,240

[22] Filed: Jun. 27, 1997

[51] Int. Cl.[6] ..... B65D 85/20

[52] U.S. Cl. ..... 206/378

[58] Field of Search ..... 206/372, 378, 206/379; 312/72, 97.1

[56] References Cited

U.S. PATENT DOCUMENTS

| | | | |
|---|---|---|---|
| D. 250,433 | 11/1978 | Malcolm . | |
| D. 355,554 | 2/1995 | Phelps . | |
| 3,063,551 | 11/1962 | Russell | 206/379 |
| 4,337,860 | 7/1982 | Carringan . | |
| 4,756,412 | 7/1988 | Graves et al. | 206/372 |
| 4,927,020 | 5/1990 | Randy . | |
| 4,941,570 | 7/1990 | Kruger et al. . | |
| 5,050,733 | 9/1991 | Brennan . | |
| 5,071,004 | 12/1991 | Rivera . | |
| 5,080,230 | 1/1992 | Winnard . | |
| 5,139,144 | 8/1992 | Robert, Jr. . | |
| 5,228,570 | 7/1993 | Robinson . | |
| 5,344,012 | 9/1994 | Matthews . | |
| 5,398,823 | 3/1995 | Anders . | |
| 5,467,874 | 11/1995 | Whitaker . | |
| 5,500,631 | 3/1996 | Negus . | |
| 5,511,673 | 4/1996 | Folk . | |
| 5,560,480 | 10/1996 | Singleton . | |

OTHER PUBLICATIONS

Accessory Review Products, Hand Tool Organization, List of products reviewed at Dec.8, 1995 meeting.

Sears "The Auto Shop Catalog," Shop Tools & Equipment, undated.

Sporty's Tool Shop Catalog (Christmas 1996 issue).

TEDA Tool Catalog, undated.

Sears Power and Tool Catalog, p. 43, undated.

Snap–On Tool Catalog, p. 37, undated.

Mac Tool Catalog, p. 64, undated.

Waterloo Standard Metal Boxes, Waterloo Industries, Inc., undated.

Waterloo Industries Drawer Socket Organizer, undated.

Waterloo Industries Inc. Tote Tray 20" drawing No. 265200, dated Oct. 19, 1987.

Waterloo Industries Inc. 103 Piece Socket Organizer drawing No. 713401, dated Sep. 18, 1991.

Waterloo Industries Inc. ⅜" Socket Tray drawing No. 713502, dated Feb. 5, 1993.

Waterloo Industries Inc. ¼" Socket Rack drawing No. 7135–05, dated Apr. 7, 1983.

Waterloo Industries Inc. ⅜" Socket Tray drawing No. 380550, dated Apr. 18, 1991.

*Primary Examiner*—Jimmy G. Foster
*Attorney, Agent, or Firm*—Banner & Witcoff Ltd.

[57] ABSTRACT

A container for sockets is fabricated from molded plastic components including opposed sections or segments forming a case with a circular through passage that accepts or retains a socket storage wheel. A rotatable cover fits over the socket storage wheel immediate a molded handle and a molded storage pocket. The cover interacts with a hinged lid associated with an auxiliary storage pocket. Sockets may be stored on pegs positioned on the storage wheels and ratchets, extensions and other tool items may be retained within the auxiliary storage pocket.

12 Claims, 7 Drawing Sheets

PORTABLE CONTAINER FOR SOCKETS

BACKGROUND OF THE INVENTION

This invention relates to an improved container or case for holding a plurality of sockets.

Sockets are tools which are utilized in combination with ratchets and other operative devices for installing and removing bolts, nuts and similar fasteners. There are dozens of variously sized sockets, though sockets typically come in three primary drive sizes: ¼ inch drive, ⅜ inch drive and ½ inch drive. Of course, metric socket sizes are now more popular, particularly as the United States adopts the metric system. Sockets also have distinct socket lengths and heights. Thus arranging sockets in a systematic or efficient manner for purposes of easy identification, use and storage is difficult at best.

Socket holders are available in the marketplace, but typically socket holders do not satisfy all the needs of a mechanic or other user. For example, socket holders are often designed to hold only one drive size, e.g. one-half inch drive size. Socket holders often have a limited storage capacity and may not be designed to be portable or transportable. Additionally, socket storage devices are often incapable of storing extra parts or components such as ratchets and extensions. Further, such containers normally provide no identification means to assist selecting a desired socket or drive size. Another aspect of many socket containers is the lack of a handle or means to suspend or support such a socket container. Protection of the contents or the drive sockets from dirt, dust and contamination is often not available. These deficiencies, among others, inspired the development of the present invention.

SUMMARY OF THE INVENTION

Briefly, the present invention comprises a container for sockets fabricated from molded plastic component parts comprising first and second molded sections having a circular through passage, a molded handle and a storage pocket for items such as ratchets and extensions. The through passage is configured to receive one of a number of select circular storage wheels wherein each circular wheel is designed for storage of certain size drives or sockets. Thus, each circular wheel is fixed within the circular through passage of the mated molded sections or case. The handle is molded at one end of the case, and a storage pocket is molded into the opposite end of the case. The storage pocket includes a hinged cover. A circular cover fits over the socket storage wheel and rotates to expose a radial slot to desired sockets stored on the wheel. The circular cover also includes a lip which overlies the pocket cover and holds the cover in the closed position. Rotation of the cover will disengage the lip from the pocket lid so that the storage pocket may be opened. Any one of various circular socket holder wheels may be installed in the circular through passage to accommodate sockets having various drive sizes.

Thus, it is an object of the invention to provide an improved case or container for sockets.

It is a further object of the invention to provide a container for sockets wherein multiple drive sizes may be stored in the same container.

Yet another object of the invention is to provide a socket holder which is capable of holding standard height sockets as well as deep well sockets, metric sockets and other sockets of various size and configuration.

Yet a further object of the invention is to provide a carrier or container for sockets which includes an additional storage pocket for extensions, ratchets and the like.

Another object of the invention is to provide a container for sockets which includes a handle integral with the container.

Another object of the invention is to provide a socket holder which has at least one flat side so that the container can be easily stored or supported on its flat side.

A further object of the invention is to provide a socket holder with indicia indicating the particular size and location of sockets stored within a container.

Another object of the invention is to provide a container for sockets which includes a transparent protective cover for the sockets wherein the cover includes a radial slot for exposure of desired sockets for removal from the container.

Another object of the invention is to provide an easily transportable container for sockets which is compact and may be used for storing sockets as well as extensions, ratchets and other items used in combination with the sockets.

Another object of the invention is to provide a container for sockets which is economic, rugged and inexpensive.

These and other objects, advantages and features of the invention will be set forth in greater detail in the description which follows.

BRIEF DESCRIPTION OF THE DRAWINGS

In the detailed description which follows, reference will be made to the drawings comprised of the following figures.

DESCRIPTION OF THE PREFERRED EMBODIMENT

Figure 6:
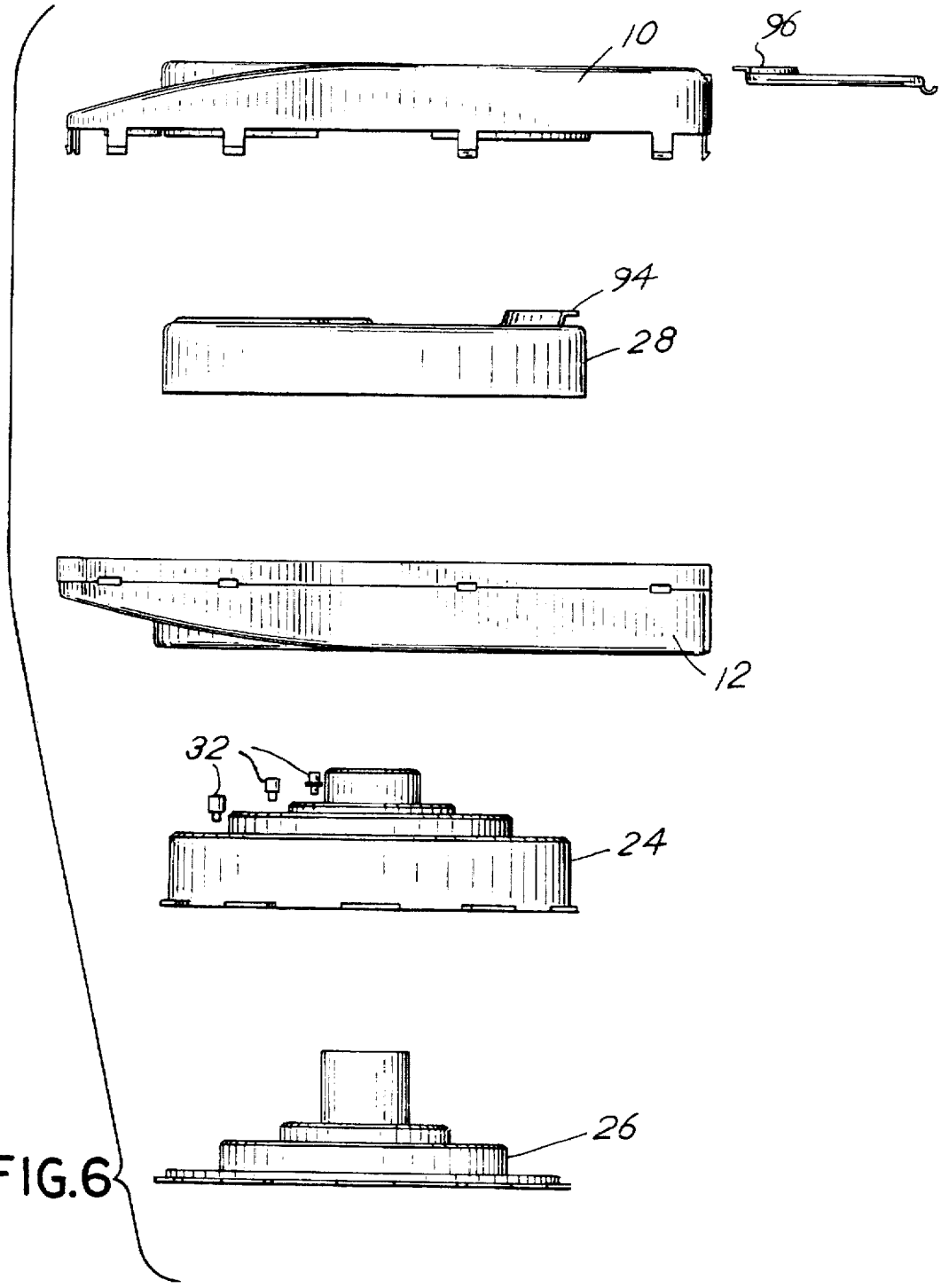
FIG. 6 is an exploded side view of the component parts of the container of FIG. 1.

Referring to the figures, the container for sockets of the invention is comprised of first and second molded plastic sections 10 and 12 which have a generally congruent profile or configuration and are generally mirror images of one another with constructural differences discussed in detail below. The congruent sections 10 and 12 are snap fitted together as also will be described below to form the main body of the case or container for the sockets. The congruent sections define a handle 14, a storage pocket 16 and a socket storage bay 18. As shown more fully in FIGS. 6 and 7, the storage bay 18 comprises a cylindrical through passage 20 in section 10, having an axis 22. A socket wheel 24 or 26 is fitted into the through passage 20 as described in greater detail below. A wheel cover 28 fits over the wheel 24 or 26 and is rotatable to expose a radial slot 30 in the wheel cover 28 to sockets which are mounted on pegs, such as pegs 32, inserted into a wheel such as wheel 24. A storage cover or lid 34 is hinged to the section 10 and covers pocket 16 defined by the sections 10 and 12 in which extensions, ratchets and other tools may be maintained.

Thus the principal component parts of the container include the mated sections 10 and 12, the socket wheel 24 or 26 having pegs 32 for mounting sockets thereon, a rotatable wheel cover 28 and a hinged lid or cover 34. These component parts are typically made from a molded plastic material. The cover 28 is typically made from a transparent molded plastic material. The component parts are snap fitted together and when assembled, provide a compact container typically having a thickness of approximately four (4) inches and a height of approximately sixteen (16) inches and a width of approximately eleven (11) inches. Note that the cover or lid 34 may also be made from transparent material.

Referring further to each of the component parts, the following features are noted. The section 10 includes a generally planer bottom wall 36 and flat connected side walls 38 and 40 which are transverse or generally perpendicular to wall 36. The walls 38 and 40 form or join together to define a handle section 42. Depending tabs, such as tabs 44, are provided for interlocking with appropriate slots 46 in the companion section 12. The section 10 further includes hinged slots 48 which are adapted to receive hinge leaves such as hinge leave 50 of cover or lid 34. The section 10 further includes a circular through passage 20. The diameter of the through passage 20 is greater than the diameter of the cover 28 so that the cover 28 and, more particularly, a skirt 52 which is a circumferential skirt, will slide easily within the passage 20 rotatable about axis 22 when the component parts are assembled.

The container or case includes a second half or section 12 which includes a bottom wall 54, side walls 56 and 58, all of which are flat. The walls 56 and 58 extend transversely or at right angles from the wall 54 and are generally congruent with the walls 38 and 40 of the top half or section 10. The side walls 56 and 58 are joined together to form a handle section 64 which mates with the handle section 42 of the case top half or top section 10. The configuration of the top section 10 and bottom section 12 is such that the sections are generally congruent. Note, however, that the skirt or wall 58 of section 10 has a lesser diameter than the segmented wall or skirt 60 of section 12. The wall 58 thus fits against the non-recessed portions 62 of the wall 60 when the component parts are assembled and locked together by virtue of the tabs 44 engaging with the slots 46. Assembly of the sections 10 and 12 thus provides a container with a pocket or storage bay or area 66, a through passage having an axis 22 and a handle 14 defined by the handle sections 42 and 64.

The assembled sections 10 and 12 are adapted to receive any one of a number of wheels such as wheels 24 and 26. The wheels 24 and 26 are designed for storage of various sized sockets, either metric or otherwise. Thus referring to wheel 24, the wheel 24 includes a series of elevated platforms 70, 72, 74 and 76. The platforms 70, 72, 74 having the larger circumferential extent, include openings 78 molded therein. Pegs 32 are fitted into the openings 78. The pegs 32 are compatible with sockets which fit over the pegs 32 for storage of sockets. The upper or inner platform 76 includes a chart either molded thereon or attached thereto which assists in identification and selection of the sockets. It is to be noted also that there is a region 80 of the platforms 70, 72 and 74 (designated with the dotted lines) in which there are no openings 78 for pegs 32. The region 80 is provided as an open area or open space of the platforms 70, 72 and 74 so that the radial slot 30 or opening 30 can be placed over the region 80 when the container is assembled, thereby precluding exposure of any of the sockets stored on the pegs 32. Thus when the region 80 is aligned with the radial slot or passage 30, the sockets on the pegs 32 may not be removed since they are not appropriately exposed through the slot 30 of cover 28.

Figure 5:
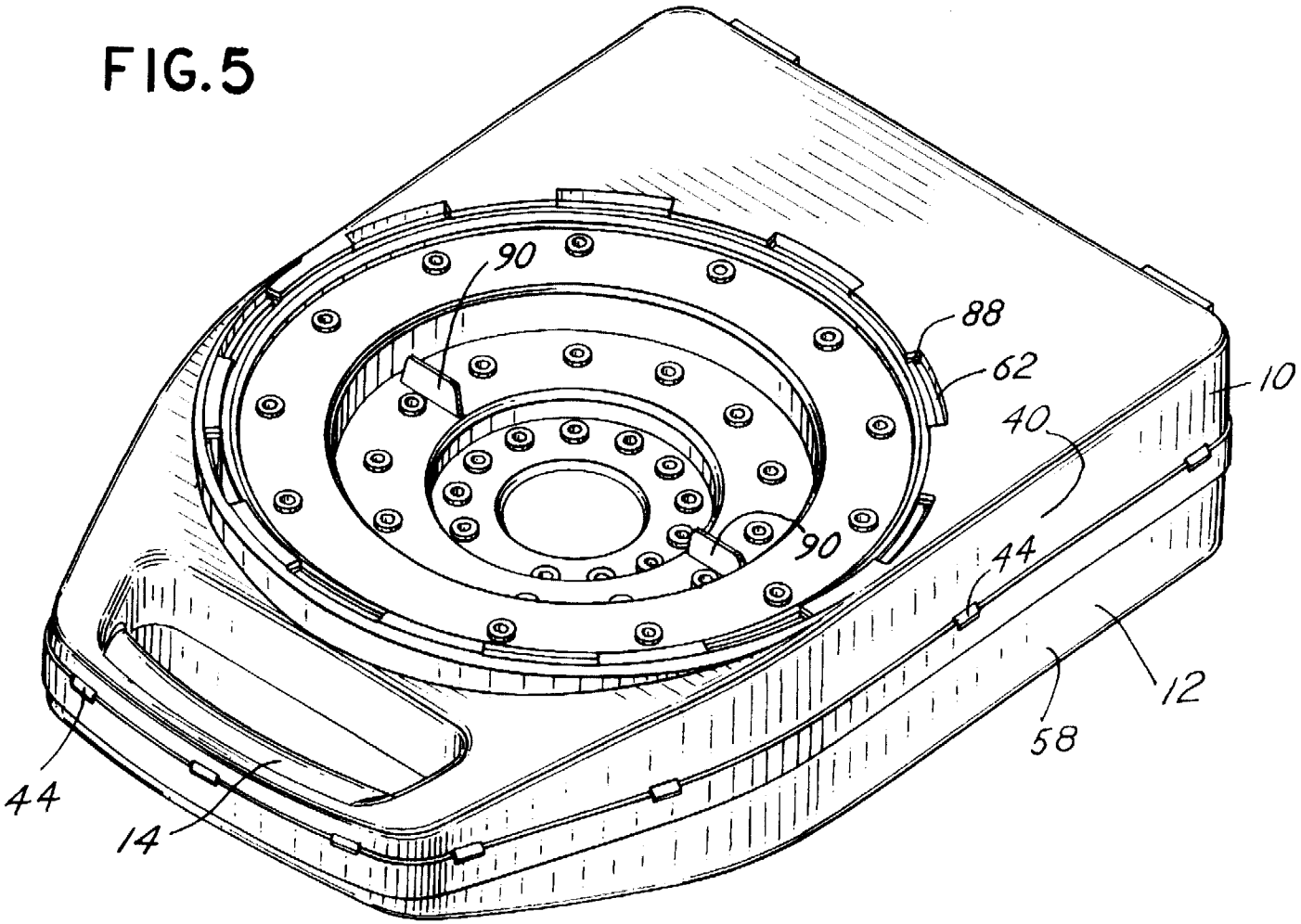
FIG. 5 is an isometric view of the bottom of the container of FIG. 1.

The socket wheel 24 further includes a series of radially projecting tabs 84 arranged about the outer periphery of a support skirt 86. The tabs 84 are adapted to fit into the recesses 62 of the section 12. The entire wheel 24 may then be rotated so that the tabs 84 will fit into slots such as slots 88 to thereby hold the wheel 24 in position in the section 12. A set screw may then be used to hold the wheel 24 fixed to section 12. This is illustrated in further detail in FIG. 5. Note that the bottom surface of the wheel 24 includes projecting tabs 90 which may be manually gripped to facilitate rotation of the wheel 24 in the clockwise direction so as to engage the tabs 84 in the recesses 62 and then facilitate rotation of the wheel 24 into the slots 88.

Figure 7:
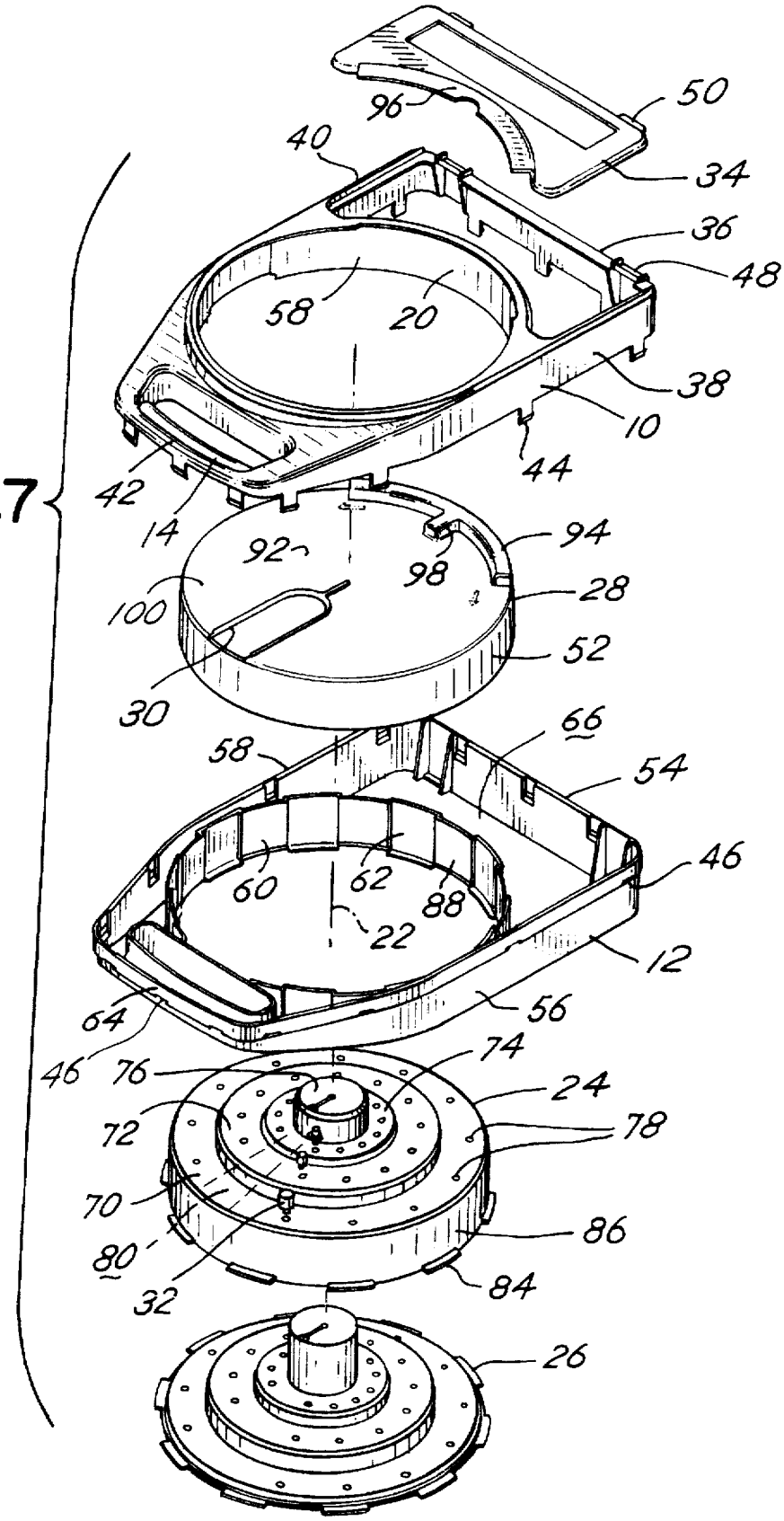
FIG. 7 is an exploded isometric view of the component parts of the container of FIG. 1.

FIG. 7 depicts two wheels 24 and 26. Wheel 24 is adapted or designed to support standard sized sockets by way of example. The second wheel 26 does not include a deep skirt 86. Therefore the second wheel 26 is designed to receive extended sockets, also known as deep well sockets. The component parts of the wheel 26 are otherwise the same as the wheel 24.

The wheel cover 28 includes a transparent top section 92, a side skirt 52, and a molded lip 94 which extends part way about the periphery of the cover 28. The diameter of the molded, depending skirt 52 is such that the skirt 52 will slidably engage against the side 58 of the passage 20. The wheel cover 28 may further include various indicia indicating the size of the sockets stored within the container.

Figure 1:
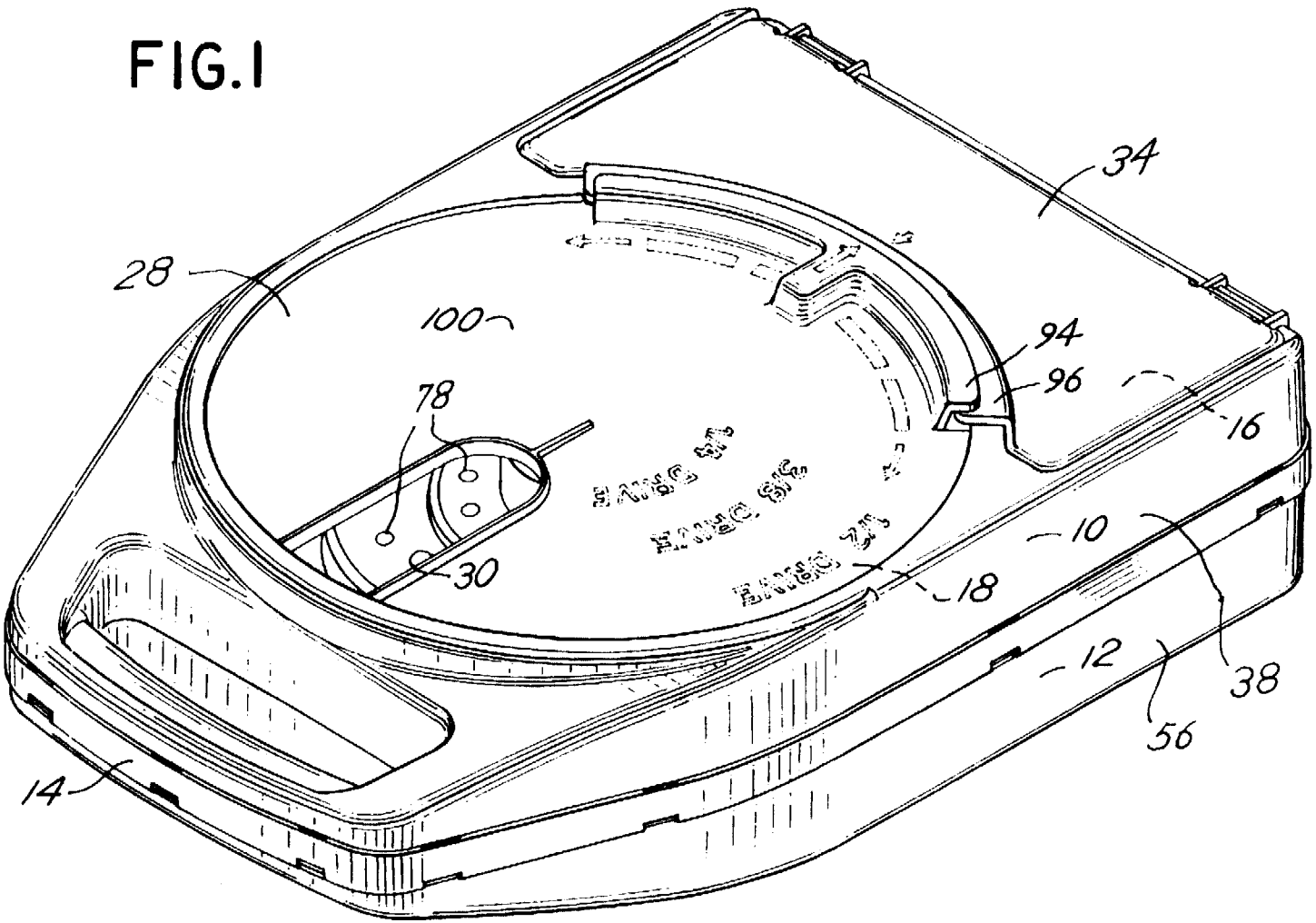
FIG. 1 is an isometric view of the container for sockets of the invention.
Figure 2:
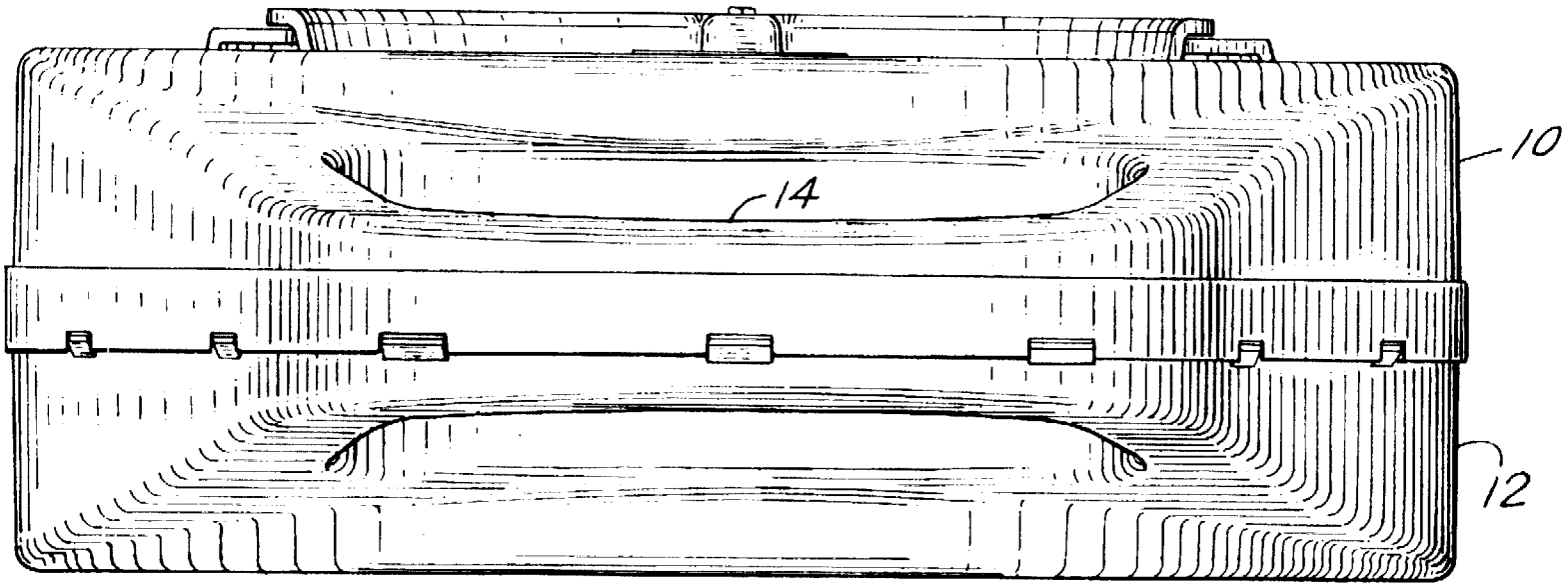
FIG. 2 is an end view of the container of FIG. 1 as viewed toward the handle of the container.
Figure 3:
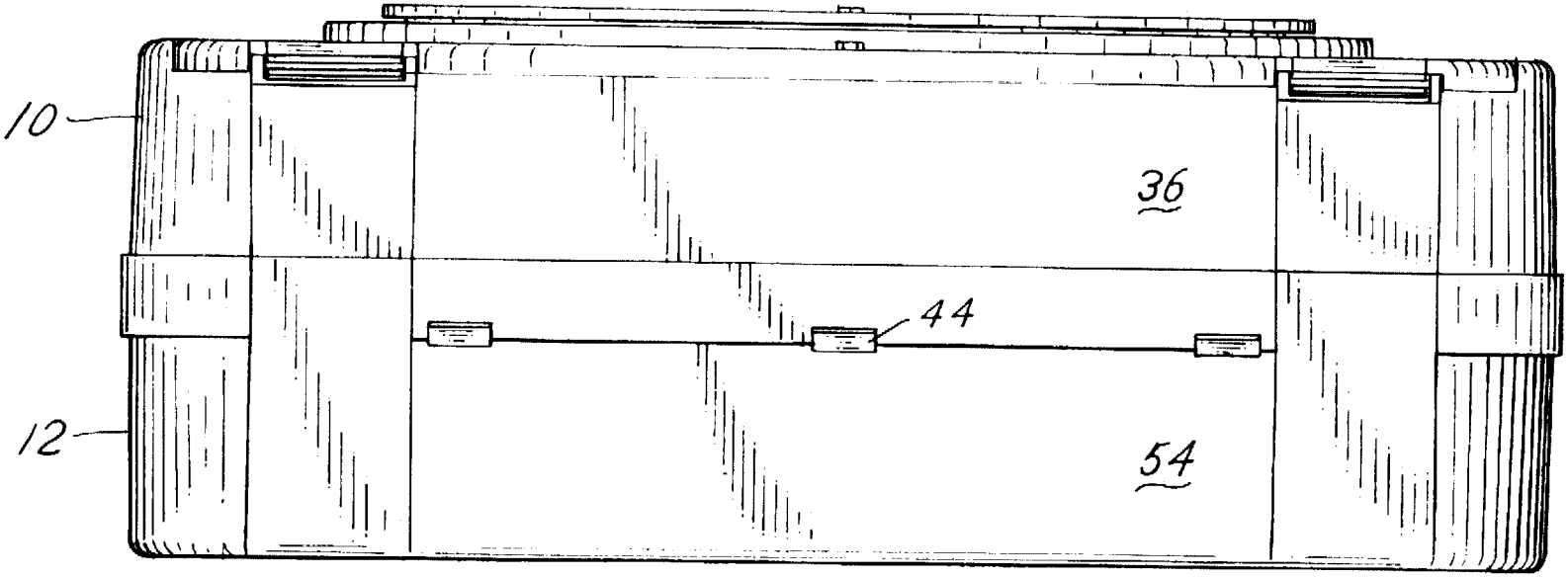
FIG. 3 is an end view of the container of FIG. 1 as viewed from the bottom or opposite from the end of FIG. 2.
Figure 4:
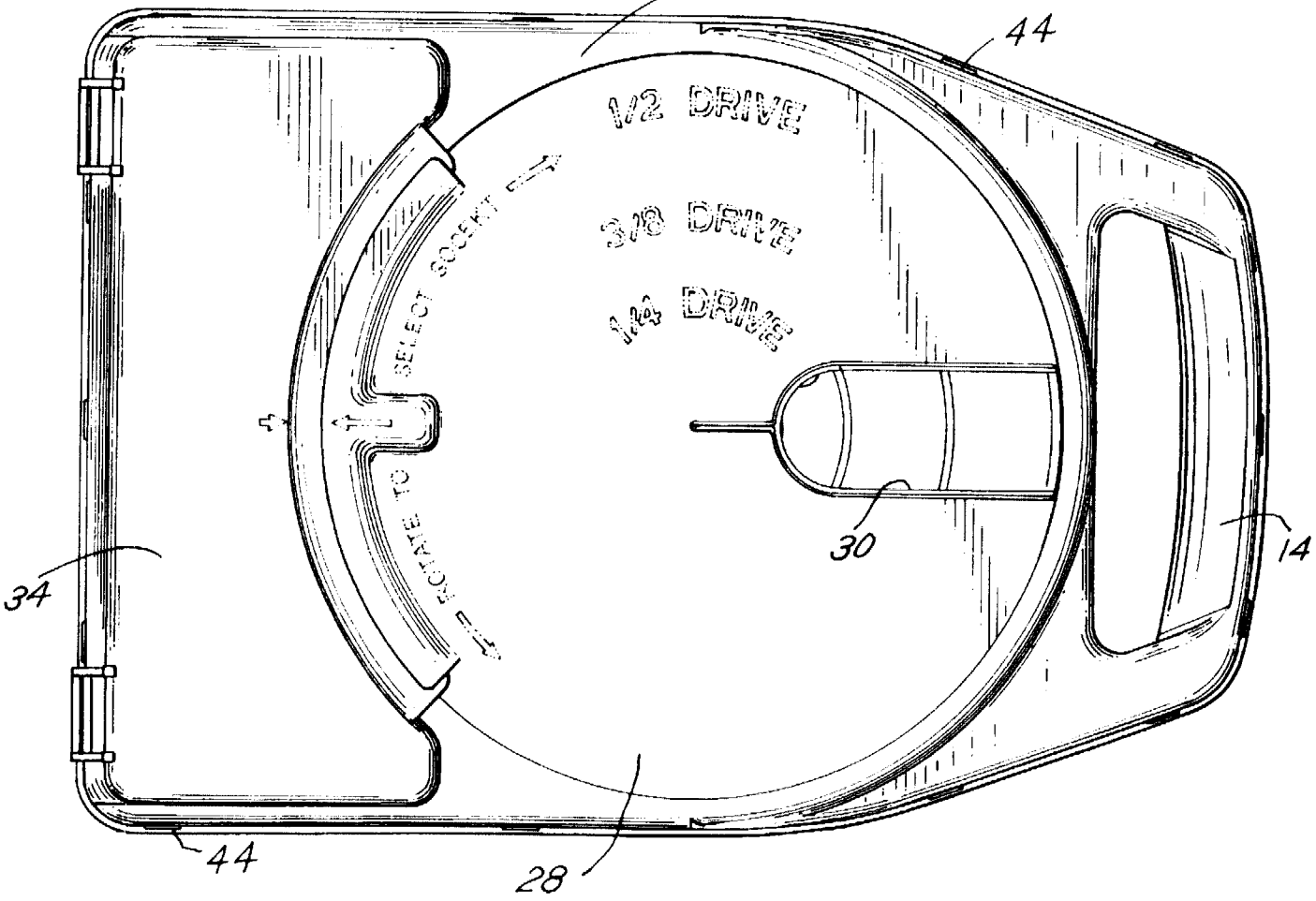
FIG. 4 is a top plan view of the container of FIG. 1.

The lid 34 includes an arcuate rib 96 which cooperates with the lip or tab 94. Thus when the cover 28 is rotated to a position such as depicted in FIG. 1, the tab 94 retains the rib 96 and thus the cover 34 in position over a pocket 66 as previously defined. Typically as designed, the container will accommodate one of two socket wheels as depicted although additional socket wheels may be utilized and designed for holding sockets or other items. Only one wheel can be used at a given time in the container. The wheels depicted are designed to have four concentric levels about a center axis 22 of the wheel. However, additional platforms may be provided or fewer platforms may be provided. In the embodiment shown, each of the platforms has 12 pegs 32 arranged circumferentially about the center axis of the wheel. Again, however, the number and spacing of the pegs is optional.

The top platform 76 of each of the wheels as described before may include a label. The label may be color keyed and may be replaced if necessary.

It is noted that the wheel cover 28 may rotate in a full circle or 360° within the container. Molded into the top of the cover 28 is a rib 98 which facilitates manual gripping and rotational movement of the cover 28. Note also that the indicia on the wheel cover 28 may be used to facilitate locating the desired drive size of socket. Additionally, it is noted that the cover 28 as well as the wheels, such as wheels 24 and 26, are appropriately dimensioned to maintain a minimum clearance between the inside top 100 of the cover 28 and sockets which are placed on pegs. This minimum clearance is achieved by appropriate positioning of the platforms, such as platform 70, and maintaining appropriate tolerances between the platform and the top 100 of the cover 28. Because of this dimensioning relationship, sockets are maintained on their designated pegs when the container is carried by the handle in an upright position, assuming, of course, that the cover 28 is maintained in the position as illustrated in FIG. 1 for example.

Various modifications and changes may be made to the container construction including substitution of various wheels having various configurations for holding various types of elements by way of example. Thus the invention is to be limited only by the following claims and their equivalents.

What is claimed is:

1. A container for sockets comprising, in combination:

a case including first and second generally congruent sections, said sections opposed and joined together, each section including a central, circular through passage having an axis, an integral handle adjacent one side of the through passage and interlocking means for joining the sections together;

a circular socket holder wheel including at least two circular platforms, said wheel sized to fit in the circular through passage and projecting into the through passage, said wheel including means for attaching the wheel to one of the sections, said wheel including socket supports arrayed on the platforms; and a circular wheel cover slidably fitted over the socket holder wheel, said cover rotatable relative to the wheel, said cover including a radial slot which exposes selected socket supports upon rotation of the wheel cover.

2. The container of claim 1 further including a storage pocket formed by the case sections adjacent the circular through passage, and a hinged pocket cover attached to one section and pivotal between a pocket exposed and pocket covered position, said circular wheel cover including a projecting lip which overlies the pocket cover to retain the pocket in the covered position, said circular wheel cover rotatable to remove the projecting lip from overlying the pocket cover thereby allowing the pocket cover to pivot to the pocket exposed position.

3. The container of claim 1 wherein the wheel cover is transparent.

4. The container of claim 1 wherein the case sections are molded plastic and snap fitted together.

5. The container of claim 2 wherein the handle and pocket are positioned on opposite sides of the socket holder wheel.

6. The container of claim 1 wherein the through passage circumference is greater than the circumference of the wheel, and wherein the wheel cover includes a circumferential skirt slidably fitted between the through passage and the wheel.

7. The container of claim 1 wherein the case has a flat bottom face and flat parallel, spaced side faces extending transversely from the bottom face, said side faces connecting into the handle.

8. The container of claim 1 including an internal circular wall defining the through passage, said wall including at least one axial groove bounded at one side of the passage by a support ledge, said internal circular wall further including a peripheral retention slot adjacent the support ledge; and said socket holder wheel including a compatible projecting tab on the circumference of the wheel, said tab axially slidable in the groove and retained in the slot by rotation of the wheel about its axis following insertion of the wheel and tab into the groove against the support ledge.

9. The container of claim 1 wherein the wheel platforms include vertical support pegs for holding individual sockets as the socket supports.

10. The container of claim 1 wherein the socket supports are arrayed in a pattern correlated with the size of the socket.

11. The container of claim 1 including indicia on the wheel correlated to the size of the socket retained on the socket supports.

12. The container of claim 1 including more than one wheel for positioning in the through passage.

* * * * *